United States Patent [19]

Battel et al.

[11] Patent Number: 4,741,357

[45] Date of Patent: May 3, 1988

[54] WASHING MACHINE WITH A CONTROL SYSTEM FOR CONTROLLING THE SUPPLY OF WATER

[75] Inventors: Mario Battel; Claudio Milocco, both of Pordenone, Italy

[73] Assignee: Industrie Zanussi SpA, Prodenone, Italy

[21] Appl. No.: 55,331

[22] Filed: May 28, 1987

[30] Foreign Application Priority Data

Jun. 4, 1986 [IT] Italy ..... 45730 A/86

[51] Int. Cl.[4] ..... F16K 31/00; F16K 31/12

[52] U.S. Cl. ..... 137/387; 137/565; 417/38

[58] Field of Search ..... 137/386, 387, 565, 577, 137/624.11, 624.13; 417/38

[56] References Cited

U.S. PATENT DOCUMENTS

| | | | |
|---|---|---|---|
| 2,592,314 | 4/1952 | Morton | 137/387 |
| 3,159,174 | 12/1964 | Searle et al. | 137/387 |
| 3,294,110 | 12/1966 | Rauszer | 137/386 |
| 3,490,486 | 1/1970 | Cushing | 137/387 |
| 4,168,615 | 9/1979 | Condit | 137/387 |

FOREIGN PATENT DOCUMENTS

| | | |
|---|---|---|
| 0118719 | 9/1984 | European Pat. Off. . |
| 0146719 | 7/1985 | European Pat. Off. . |

*Primary Examiner*—George L. Walton
*Attorney, Agent, or Firm*—Wenderoth, Lind & Ponack

[57] ABSTRACT

A washing machine includes a tub having a water collecting well, a water suply conduit provided with a controllable valve for supplying water to the well during at least one water supply phase of the operation of the washing machine, and a circulation pump for circulating water collected in the well during at least a latter portion of the supply phase. A control system automatically controls operation of the valve and thereby the supply of water to establish a minimum water level within the well required for optimum operation of the circulation pump. The control system includes a control chamber and an overflow wall having a predetermined overflow level and communicating the well with the control chamber, such that when the level of water in the well reaches the overflow level the water overflows the overflow wall into the control chamber. A calibrated flow opening communicates the intake of the circulation pump with the control chamber, such that operation of the circulation pump draws water from the control chamber through the flow opening. A pressure switch is operatively connected to the valve and is responsive to the pressure within the control chamber to close the valve when the rate of water overflowing the overflow wall into the control chamber is at least equal to the rate of water flowing from the control chamber through the flow opening.

3 Claims, 2 Drawing Sheets

PRESSURE AT OUTLET 18

PRESSURE IN CHAMBER 14

WASHING MACHINE WITH A CONTROL SYSTEM FOR CONTROLLING THE SUPPLY OF WATER

BACKGROUND OF THE INVENTION

The present invention relates to a washing machine, particularly a dishwashing machine, provided with an improved water supply control system.

It is known from U.S. Pat. No. 3,294,110 to provide a device for controlling the level of a liquid supplied to a tub. Such device includes a first chamber adapted to receive liquid (water) from a supply main and communicate via an overflow wall with a second chamber cooperating with a pressure switch adapted to control a solenoid valve for controlling the supply of water from the water main. The first chamber also communicates with the tub through an intake of a discharge pump. During operation, the water from the water main flows into the tub into the first chamber to fill the first chamber up to the level of the overflow wall, whereupon the water overflows into the second chamber, whereupon the pressure switch is abruptly actuated to close the supply solenoid valve. This control device is of simple construction and is reliable in operation. However, its use in a washing machine, particularly in a dishwashing machine, nevertheless is unsatisfactory because it is designed to function with the respective machine in an inoperative state, i.e. when the circulation pump is not operating. This means that the control device, contrary to what would be desirable, is not capable of stopping the water supply to the tub as soon as the minimum water level required for proper operation of the circulation pump has been achieved. Particularly, this control device does not take into account the various parameters such as the charge of dishes or the like, the amount of water in circulation, the characteristics of the pump and of the piping within the machine, which factors together determine the optimum level of water to be charged into the tub.

However, with the increasing concern about the conservation of resources, it becomes fundamentally important to reduce the amount of water supplied to a washing machine for each operating cycle to the absolute minimum required for effective operation. Accordingly, it has been proposed, as described in European Patent Application No. EP-A-0,118,719, to provide a dishwashing machine with a water supply control system of the dynamic type capable of taking into account all of the above mentioned parameters and factors. Particularly, this control system comprises a water supply valve controlled by a program control unit so as to open during a water supply phase during which the circulation pump of the machine also is in operation. A transducer generates an output signal proportional to the output pressure of the pump. The output signal of the transducer is applied to a control means responsive to variations of the output signal for controlling the valve when the magnitude of these variations drops below a predetermined value. While this control system is highly accurate in operation, it requires relatively complicated control and actuating components, particularly electronic components, which it would be desirable to eliminate.

SUMMARY OF THE INVENTION

With the above discussion in mind, it is an object of the present invention to provide a washing machine equipped with an improved water supply control system of simple and reliable operation and which is capable of accurately establishing the minimum water level required for optimum operation of a circulation pump provided in the washing machine.

This and other objects are achieved in accordance with the present invention by the provision of a washing machine including a tub having a water collecting well, a water supply conduit provided with a controllable valve for supplying water to the well during at least one water supply phase of the operation of the washing machine, and a circulation pump for circulating water collected in the well during at least a latter portion of the supply phase. Specifically according to the present invention there is provided an improved control system for automatically controlling the operation of the valve and thereby the supply of water to the washing machine to establish a minimum water level within the well required for optimum operation of the circulation pump. The control system includes a pressure control chamber, at least one overflow wall having a predetermined overflow level and communicating the well with the control chamber, such that when the level of water in the well reaches the overflow level the water overflows the overflow wall into the control chamber. A calibrated flow communication means communicates on one side thereof with an inlet or intake or the circulation pump and on the other side with the control chamber. Accordingly, operation of the circulation pump draws water from the control chamber through the flow communication means to be circulated by the circulation pump. Pressure responsive means is operatively connected to the controllable water supply valve and is responsive to the pressure within the control chamber to close the valve when the rate of water overflowing the overflow wall into the control chamber is at least equal to the rate of water flowing from the control chamber through the flow communication means. Thus, the control system of the present invention automatically is accommodated to the above parameters and factors to achieve a minimum water level within the well which will ensure optimum operation of the circulation pump. The pressure responsive means controls the opening and closing of the water supply valve in response to the pressure within the control chamber, and this pressure is a function of the rise and flow of the water level as well as the suction effect of the circulation pump.

BRIEF DESCRIPTION OF THE DRAWINGS

Other objects, features and advantages of the present invention will be apparent from the following detailed description of a preferred embodiment thereof, taken in conjunction with the accompanying drawings, wherein.

DETAILED DESCRIPTION OF THE INVENTION

Figure 1:
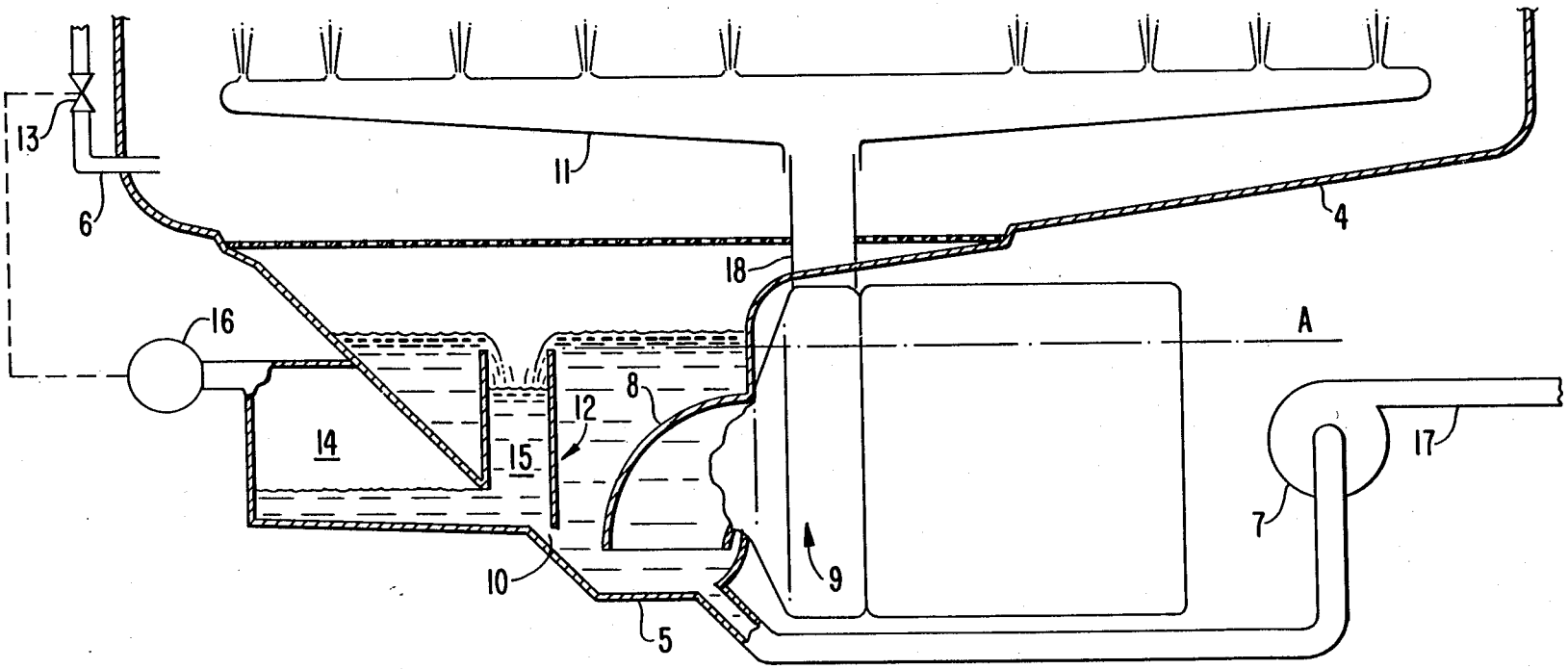
FIG. 1 is a diagrammatic and schematic view of a portion of a washing machine including a preferred embodiment of the improved control system of the present invention.

With reference to FIG. 1, there is shown therein the bottom portion of a washing machine (which preferably is a dishwasher) including a washing tub 4, shown only partially, the bottom of which is provided with a water collecting well 5 for collecting the liquid (water) the level of which is to be controlled. Well 5 is adapted to be filled with water from a water main through a supply conduit 6 provided with a controllable supply valve 13 which is intended to be controlled in a known manner by a program control unit of the washing machine (not shown) and also in accordance with the present invention by means of a pressure sensitive means 16, for example a pressure switch or the like, to be described in more detail below. Collecting well 5 can be emptied, for example at the end of a wash cycle of the washing machine, in a conventional manner by means of a pump 7 and a discharge pipe 17. The washing machine further includes a circulation pump 9 having an inlet or intake 8 disposed within collecting well 5 and an outlet 18 connected to at least one rotatable sprinkling arm 11 for spraying water on dishes or the like (not shown) positioned in a normal manner within the tub 4. Thus, during a water supply phase of the operation of the washing machine valve 13 is opened to supply water from a water main through conduit 6 into tub 4, and the water collects in well 5. As is known, during a portion of this water supply phase, and particularly at least during a latter portion thereof, circulation pump 9 is operated to pump water from well 5 to sprinkling arm 11, after which the water collects back in well 5.

In accordance with the present invention, there is provided an automatic control system for ensuring that valve 13 is closed when the water level within well 5 reaches a minimum level required for the optimum operation of circulation pump 9, taking into account the various parameters effecting such operation, and including the charge of dishes or the like within the machine, the amount of water being circulated, the characteristics of the circulation pump and the piping within the machine, etc. Thus, it is desired that the water supply valve 13 be closed as soon as the minimum amount of water has been supplied to ensure optimum, i.e., proper and safe, operation of pump 9, without the pump running out of water at intake 8, and at the same time avoiding the supply of two great a quantity of water to the machine.

Thus, in accordance with the present invention the liquid level control system includes a control chamber 14 and at least one overflow wall 12 communicating the interior of well 5 with control chamber 14. Thus, when the level of water in well 5 reaches the top of overflow wall 12, the water overflows wall 12 into a chamber 15 defined by wall 12 and then into control chamber 14. The cross-sectional area of chamber 15 is substantially smaller than the cross-sectional area of well 5 and extends upwardly to a predetermined overflow level A of wall 12. Level A substantially corresponds to, and is preferably somewhat lower than, the minimum dynamic water level (i.e., with circulation pump 9 in operation) to be attained by the water in well 5 for ensuring proper and optimal operation of pump 9. Accordingly, overflow level A is determined in the design stage, taking into account the characteristics of the entire water supply and circulation system of the washing machine.

Adjacent the bottom portion of overflow wall 12 is formed at least one calibrated opening 10 communicating with the intake 8 of circulation pump 9 and preferably being disposed at a location whereat opening 10 is substantially subjected to the action of the intake flow of pump 9, i.e., adjacent or opposed to intake 8. The cross-sectional area of calibrated opening 10 is smaller than that of the free space above overflow wall 12. Opening 10 thus communicates control chamber 14 with the intake of the circulation pump, such that operation of circulation pump 9 draws water from control chamber 14 through opening 10.

As indicated above, the program control unit of the washing machine is adapted to actuate the circulation pump 9 at least during the latter part of the water supply phase of the operation of the washing machine, at which time supply valve 13 is opened for admitting water to collecting well 5. Such program control unit may be as disclosed, for example, in European Patent Application No. EP-A-0,118,719. Thus, during operation such program control unit of the washing machine initiates the water supply phase by opening valve 13 to supply water to tub 4. The water thus supplied by a conduit 6 collects at the bottom of well 5 so that the water level steadily rises in well 5 and in chamber 15 communicating therewith via opening 10. In control chamber 14, the water will rise only to a certain level, since control chamber 14 is closed at the top, whereby the pressure in control chamber 14 increases. The pressure in control chamber 14 is sensed by a pressure sensitive means, for example pressure switch 16, which is operatively connected to valve 13 to open and close such valve depending upon the pressure within control chamber 14.

Figure 2:
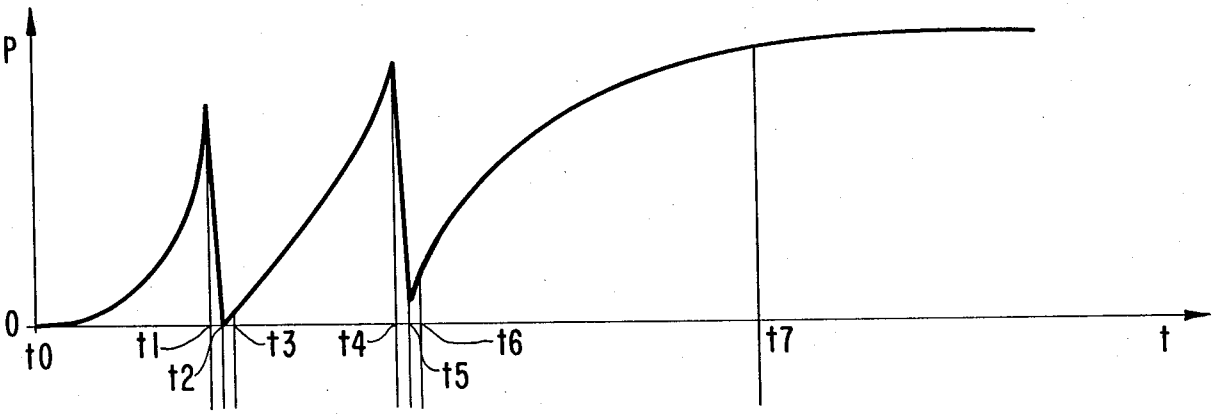
FIGS. 2 and 3 are graphs illustrating variations over time of the pressure at the outlet of the circulation pump and in the control chamber, respectively, during a water supply phase of the operation of the washing machine of FIG. 1.
Figure 3:
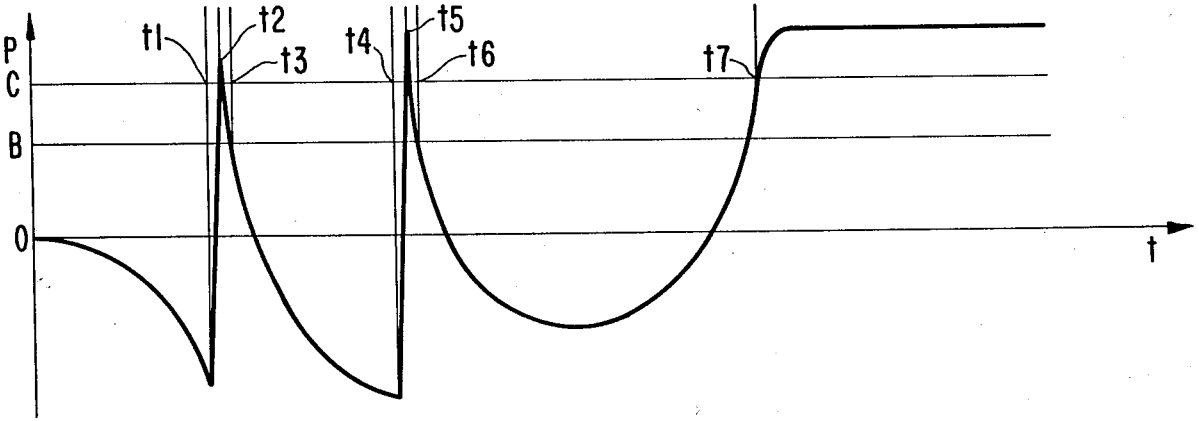

At a certain instant t0, with reference to FIGS. 2 and 3, preferably shortly before the water in collecting well 5 and chamber 15 has risen to level A, the program control unit of the washing machine initiates the operation of circulation pump 9. As shown in FIG. 2, the operation of circulation pump 9 causes the hydraulic pressure at outlet 18 to rise gradually until an instant t1, at which time the lowering liquid level in well 5 causes air to enter intake 8 together with water, and this abruptly causes pump 9 to run empty for a time period t1–t2.

Considering now the pressure within control chamber 14, i.e., the pressure acting on pressure switch 16, as indicated in FIG. 3, such pressure will decrease during the interval t0–t1 in spite of the fact that supply valve 13 is open, since the operation of circulation pump 9 causes the water level in well 5 and chamber 15 to drop. In particular, there is a considerable drop of the water level in chamber 15 due to the action of the intake flow of pump 9 on calibrated opening 10. In this regard, it is to be noted that this suction effect as well as the rise and fall of the water level in chamber 15 together determine the magnitude of the pressure within control chamber 14. During the dry-running or empty-running period t1–t2 of circulation pump 9, the suction effect of pump 9 is substantially zero. Thus, the water level in well 5 rises suddenly, with a resultant overflow over wall 12 into chamber 15 and a corresponding abrupt pressure rise in control chamber 14. It will be noted by a comparison of FIGS. 2 and 3 that the pressure variation at outlet 18 of pump 9 during this period in effect is amplified in control chamber 14 and may temporarily exceed a value C at which pressure switch 16 is calibrated to close supply valve 13.

Subsequently, due to the again increased water level in well 5, there occurs in a known manner another suction period of the operation of circulation pump 9 up to an instant t4 which is followed by, for the same reasons discussed above, another dry-running period of pump 9 up to an instant t5, whereafter another suction period is initiated. That is, the pressure at outlet 18 of circulation pump 9 increases during the period t2–t4, abruptly drops during the period t4–t5, and then starts to rise again. During these time periods the water level in collecting well 5 and particularly in chamber 15 varies in response to the operating conditions of pump 9 as described above. As a result, the pressure in control chamber 14 acting on pressure switch 16 decreases during the period t2–t4, rises abruptly to a value above C during the period t4–t5, and then tends to diminish again.

It is to be noted that during this entire time supply valve 13 stays open, except for the substantially negligible transitory periods during which the pressure in control chamber 14 exceeds the value C before it drops again to a value B at which the pressure switch 16 is calibrated for opening supply valve 13 again. As can be seen in FIG. 3, these transitory periods begin immediately before the instants t2 and t5, respectively, and end at instants t3 and t6, respectively. As a whole, the water level in collecting well 5 tends to rise in a substantially continuous manner (neglecting the above discussed variations), so that the suction effect of circulation pump 9 gradually is improved.

After instant t5 the suction effect of pump 9 approaches the optimum operational conditions, with a gradual improving proportion of water to air taken in by the pump. Corresponding thereto, after instant t5 the pressure at the outlet 18 of circulation pump 9 continues to rise as shown in FIG. 2, while the pressure within control chamber 14 drops at a decreasing rate, because the water collected in well 5 starts to flow over overflow wall 12 into chamber 15 at a gradually increasing rate which tends to exceed the flow rate through calibrated opening 10. These conditions persist up to an instant t7 at which a dynamic equilibrium is attained between collecting well 5 and chamber 15. That is, at instant t7 the amount of water in tub 4 is such that the level of the water is stabilized at a value at least equal to the value of level A shown in FIG. 1. As shown in FIG. 3, during this phase the pressure within control chamber 14 at a given instant tends to reverse the previous tendency to decrease and subsequently rises abruptly above the value C substantially at the instant t7 when the dynamic equilibrium between collecting well 5 and chamber 15 is achieved. As a result, at the instant t7 the pressure switch 16 causes the supply valve 13 to be finally closed, and valve 13 will thereafter remain closed assuming normal operation, because the pressure acting on switch 16 remains at a substantially constant value above value C, and this is due to the dynamic equilibrium achieved by stabilized water level A. The further operation of the dishwashing machine then proceeds in a conventional manner.

It will be noted that the amount of water admitted to the washing tub 4 for achieving the optimum level in collecting well 5 automatically is controlled by taking into account the amount of water being circulated through tub 4, which amount may be variable in accordance with the characteristics of the water circulation circuit of the machine and with the amount of dishes and the like to be washed at any given instance. Thus, the faster pump 9 operates, the more water is necessary to achieve a stabilized water level A.

In accordance with the improvement of the present invention, the dishwashing machine thus is provided with an extremely simple, compact and reliable control system for determining and achieving the admission of an amount of water which is effectively the absolute minimum for ensuring safe and optimum operating conditions for circulation pump 9 and the associated water circulation system. Furthermore, since opening 10 always maintains communication of control chamber 14 and chamber 15 with collecting well 5, the control system is capable of continuously monitoring the water level in collecting well 5. Thus, for example in the case of a malfunction of pump 9 caused, for example, by an excessive formation of foam or by obturation of a recirculation filter (not shown) provided in the washing machine, the control system of the present invention is capable of responding to a resultant pressure drop in control chamber 14 to a value below the value B and automatically initiating a suitable corrective action, i.e., opening of supply valve 13, to reestablish the optimum liquid level A for operation of pump 9.

It is to be understood that the calibrated opening 10 may be replaced by any equivalent communication arrangement such as for instance a flow conduit formed and acting as a siphon, possibly arranged to pass over overflow wall 12. In any case, the communication means such as opening 10 is self-cleaning during operation of circulation pump 9. Further, during the discharge phase of the operation of the washing machine when discharge pump 7 is operated, the communication means such as opening 10 permits control chamber 14 and chamber 15 simultaneously to be emptied.

An important functional advantage of the dishwashing machine according to the present invention involves the above discussed "amplification" of the pressure in chambers 14 and 15 as a function of the variations of the water level in collecting well 5. This ensures a rapid and accurate response of pressure switch 16, even if the latter is of a low sensitivity with a wide tolerance. It thus, is possible to use a pressure switch of an elementary type, or even a pressure-sensitive device of a per se known type, including a diaphragm or the like subjected to the action of the pressure within control chamber 14 for directly actuating a closure element of supply valve 13. In the latter case, it obviously is possible to avoid the use of a supply valve 13 of the electromechanical type.

Although the present invention has been described and illustrated with respect to preferred features, it is to be understood that various modifications and changes may be made to the specifically described and illustrated features without departing from the scope of the present invention. Thus, by suitable dimensioning the various operative components it is possible, for instance, to avoid the pressure peaks appearing in control chamber 14 at instants t2 and t5 (FIG. 3) exceeding the value C to which the pressure switch responds. It also is to be understood that although FIGS. 2 and 3 show two peaks and dry-running periods before dynamic equilibrium is reached, this is intended to be exemplary only of the manner of operation of the present invention.

Also, it is to be understood that the washing machine improved in accordance with the present invention is not intended to be limited to a dishwashing machine as specifically illustrated, but also may be a laundry washing machine with recirculation of the laundering liquid, for example of the type described in European Patent Application No. EP-A-0,146,719.

We claim:

1. In a washing machine including a tub having a water collecting well, a water supply conduit provided with a controllable valve for supplying water to said well during at least one water supply phase of the operation of said washing machine, and a circulation pump for circulating water collected in the well during at least a latter portion of said supply phase, the improvement of control system means for automatically controlling the operation of said valve and thereby the supply of water to establish a minimum water level within said well required for optimum operation of said circulation pump, said control system means comprising:

a control chamber;

overflow wall means, having a predetermined overflow level and communicating said well with said control chamber, such that when the level of water in said well reaches said overflow level the water overflows said overflow wall means into said control chamber, resulting in a pressure increase within said chamber above the level of water therein;

calibrated flow communication means, continually communicating an intake of said circulation pump with said control chamber, such that operation of said circulation pump draws water directly from said well and also from said control chamber through said flow communication means;

whereby said control system means amplifies changes of pressure within said control chamber above the water level therein as a function of variations in the water level within said well; and pressure sensitive means, operatively connected to said valve and responsive to the pressure within said control chamber above the level of water therein, for closing said valve when the rate of water overflowing said overflow wall means into said control chamber is at least equal to the rate of water flowing from said control chamber through said flow communication means.

2. The improvement claimed in claim 1, wherein said flow communication means comprises at least one calibrated opening formed adjacent a bottom portion of said overflow wall means.

3. The improvement claimed in claim 1, wherein said overflow wall means defines a chamber connecting said well with said control chamber, said chamber having a smaller cross-sectional area than said well.

* * * * *